US006648632B2

(12) United States Patent
Berry et al.

(10) Patent No.: US 6,648,632 B2
(45) Date of Patent: Nov. 18, 2003

(54) LIGHTER

(75) Inventors: Adrian Berry, London (GB); Tat Chan, Fotan (HK)

(73) Assignee: Ronson International Limited, West Sussex (GB)

( * ) Notice: Subject to any disclaimer, the term of this patent is extended or adjusted under 35 U.S.C. 154(b) by 0 days.

(21) Appl. No.: 10/042,310

(22) Filed: Jan. 11, 2002

(65) Prior Publication Data

US 2002/0102506 A1 Aug. 1, 2002

(30) Foreign Application Priority Data

Jan. 12, 2001 (CN) ..... 1202964

(51) Int. Cl.[7] ..... F23D 3/04; F23D 14/28
(52) U.S. Cl. ..... 431/310; 431/344
(58) Field of Search ..... 431/310, 344, 431/277, 255, 153

(56) References Cited

U.S. PATENT DOCUMENTS 1,800,334 A * 4/1931 Aronson ..... 431/310
2,168,732 A * 8/1939 Dubsky ..... 431/276
3,784,352 A * 1/1974 Court ..... 431/277
3,829,737 A * 8/1974 Johnsson ..... 361/247
4,531,906 A * 7/1985 Mizukami ..... 431/146
4,640,679 A * 2/1987 Perrin ..... 431/146
5,538,417 A 7/1996 Chan
6,099,297 A 8/2000 Chan
6,099,300 A * 8/2000 Rice ..... 431/255

* cited by examiner

*Primary Examiner*—Alfred Basichas
(74) *Attorney, Agent, or Firm*—Burns Doane Swecker & Mathis LLP

(57) ABSTRACT

A lighter is disclosed as including a body and an button, the body including a piezo electric unit and a container for containing fuel under pressure, the body further including an at which a flame may he produced upon movement of the button relative to the body, and the button is slidable relative to the body parallel to a longitudinal axis of the body, and the button has an outer surface which may be operated by a user to slide the button relative to the body, and the outer surface of the button is generally orthogonal to the end of the body, and wherein the button is generally as long as the body.

34 Claims, 10 Drawing Sheets

LIGHTER

This application claims priority under 35 U.S.C. §§119 and/or 365 to 01202964.5 filed in China on Jan 12, 20001; the entire content of which is hereby incorporated by reference.

This invention relates to a lighter, and in particular a lighter which is not easily operable by a child.

BACKGROUND OF THE INVENTION

There are in existence a large number of lighters. Because of the relatively simple way in which such lighters can be operated, it is considered desirable to incorporate safety mechanism into such conventional lighters to prevent unintentional use thereof, e.g. by children. Lighter incorporating self-retrieving safety mechanisms are disclosed in, e.g. U.S. Pat. Nos. 5,538,417 and 6,099,297. Such safety mechanisms are usually very complex and thus costly and complicated to manufacture.

It is thus an object of the present invention to provide a lighter with an actuating mechanism which cannot be easily operable by a young child, so that the actuating mechanism effectively acts as a safety mechanism for preventing unintentional use of the lighter by young children.

It is also an object of the present invention to at least provide a useful alternative to the trade and public.

SUMMARY OF THE INVENTION

According to a first aspect of the present invention, there is provided a lighter including a body and an actuator, wherein said body includes a spark generator and a container adapted to contain fuel under pressure, said body further including a longitudinal end at which a flame is adapted to be produced upon movement of said actuator relative to said body, wherein said actuator is movable relative to said body substantially parallel to a longitudinal axis of said body, wherein said actuator includes an outer surface which is operable by a user to move said actuator relative to said body, wherein said outer surface of said actuator is generally orthogonal to said longitudinal end of said body, and wherein said actuator is generally as long as said body.

According to a second aspect of the present invention, there is provided a lighter including a body and an actuator, wherein said body includes a spark generator and a container adapted to contain fuel under pressure, said body further including a longitudinal end at which a flame is adapted to be produced upon movement of said actuator relative to said body, wherein said actuator is movable relative to said body substantially parallel to a longitudinal axis of said body, wherein said actuator is provided outside a lateral side of said body, and wherein said actuator is generally as long as said body.

BRIEF DESCRIPTION OF THE DRAWINGS

Embodiments of the present invention will now be described, by way of examples only, with reference to the accompanying drawings, in which.

DETAILED DESCRIPTION OF THE PREFERRED EMBODIMENTS

Figure 1:
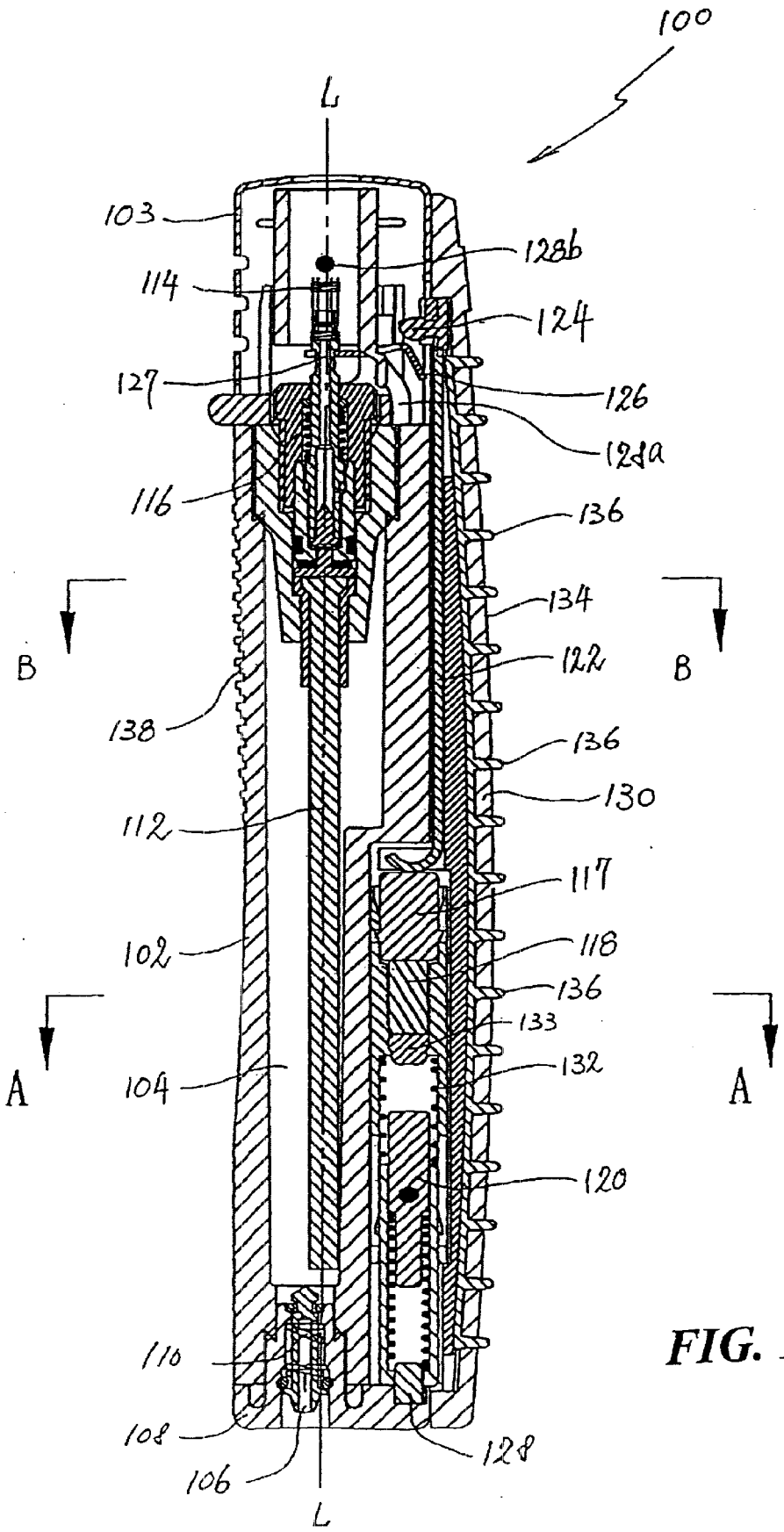
FIG. 1 is a longitudinal cross sectional view of a lighter according to a first embodiment of the present invention in a normal state.
Figure 2:
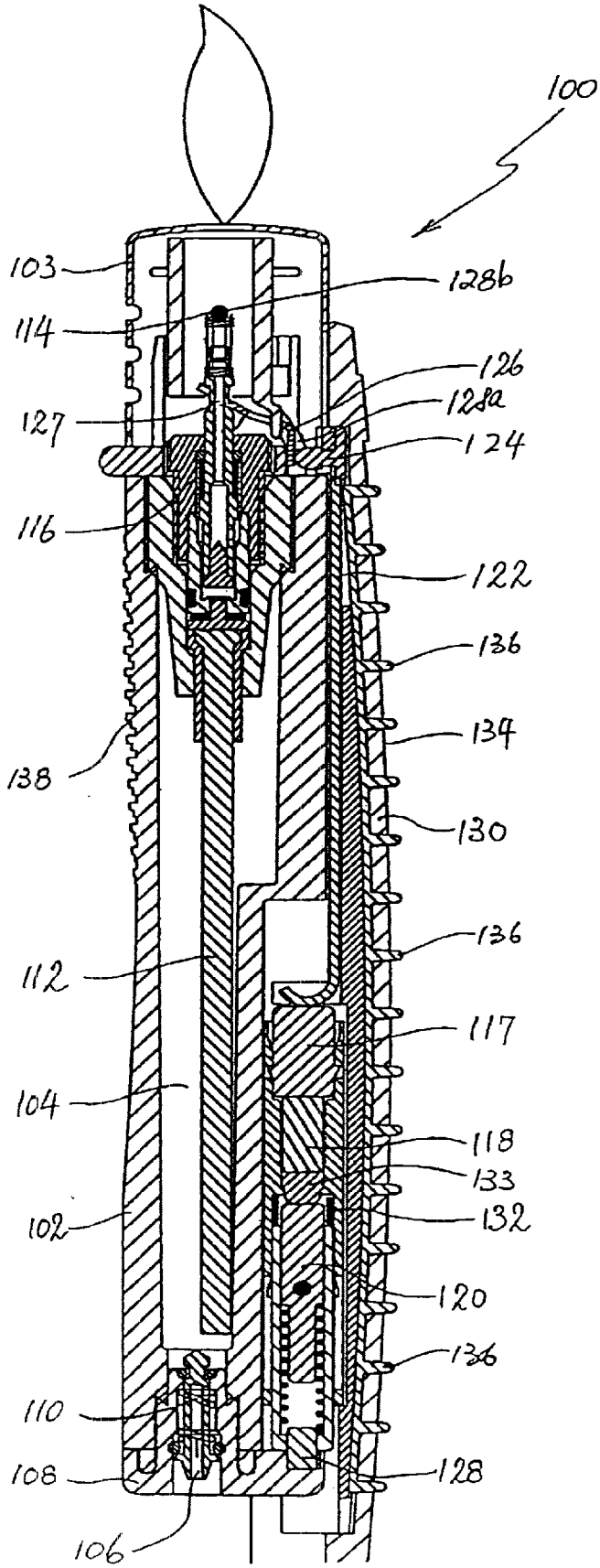
FIG. 2 is a longitudinal cross sectional view of the lighter shown in FIG. 1 in an operating state.
Figure 3B:
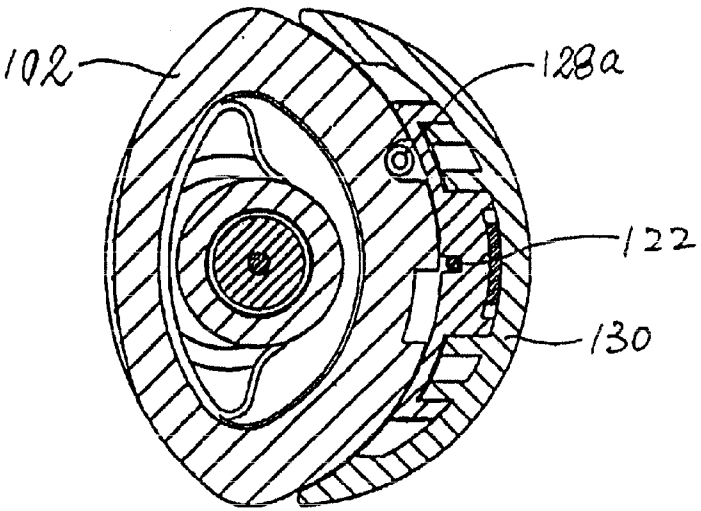
FIG. 3B is a cross sectional view of the lighter taken along the line B—B in FIG. 1.
Figure 3A:
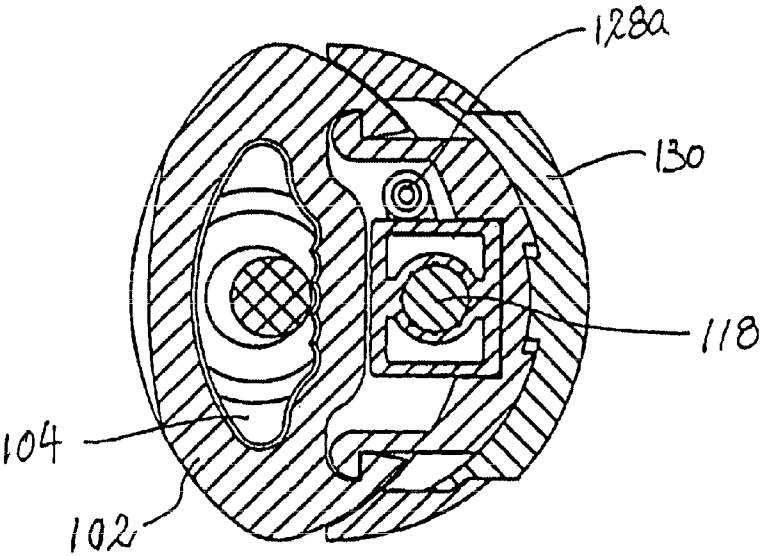
FIG. 3A is a cross sectional view of the lighter taken along the line A—A in FIG. 1.

FIGS. 1 to 3B show various cross sectional views of a lighter according to the present invention, generally designated as 100. The lighter includes a body 102 whose transverse cross section is generally oval in shape. At a top longitudinal end of the body 102 is a windscreen cap 103 made of a metallic material. Within the body 102 is provided a cavity 104 for containing fuel under pressure. Such fuel may be introduced into the cavity 104 via a valve 106 provided proximate an end cap 108 of the body 102. The valve 106 is biased by a spring 110 towards a closed configuration, as shown in FIGS. 1 and 2, whereby exit of fuel from the cavity 104 via the valve 106 to the outside environment is normally prevented. The valve 106 may be moved, in the usual manner, to an open configuration, against the biasing force of the spring 110, to allow fuel under pressure to be introduced into the cavity 104.

A tube 112 leads from the cavity 104 to an electrically conductive nozzle 114, whereby the fuel in the cavity 104 is supplied to the nozzle 114. The nozzle 114 is biased by a spring 116 to a closed position, as shown in FIG. 1, whereby exit of fuel from the cavity 104 via the nozzle 114 to the outside environment is normally prevented.

Figure 8:
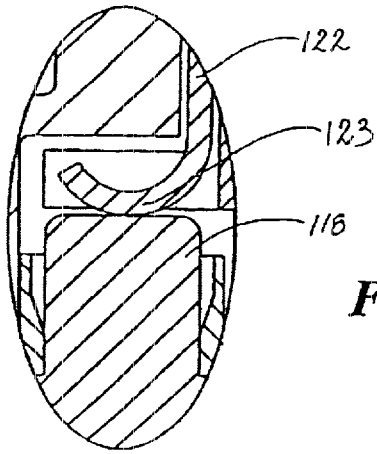
FIG. 8 is an enlarged view showing the engagement between a lead wire and an upper part of a piezo unit of the lighter shown in FIG. 1.

Provided within the body 102 are a piezo electric unit 118 and a hammer 120 for generating spark. The piezo electric unit 118 includes an upper portion 117, which is an electrically conductive back mass made of zinc alloy. Leading from and contacting with the upper portion 117 is an electrically conductive lead wire 122. As can be seen very clearly in FIG. 8, the lead wire 122 has a bent lower end 123, for ensuring better physical and electrical contact with the upper portion 117 of the piezo electric unit 118. An electrically conductive horizontal extension 124 is in contact with an upper end of the lead wire 122, so that the extension 124 and the lead wire 122 are movable simultaneously. A lever 126 made of an electrically conductive material is engaged with a neck portion 127 of the nozzle 114, and is pivotable to move the nozzle 114 to a raised open position, as shown in FIG. 2, in which fuel inside the cavity 104 is allowed to exit to the outside environment via the nozzle 114.

A hammer 120 is in electrical connection with an electrically conductive block 128 on the end cap 108. The block 128 leads, via an electrically conductive lead wire 128*a* to an end 128*b* closely proximate the exit end of the nozzle 114.

Mounted on a lateral side of the body 102 is an actuating button 130, which is roughly as long as the body 102. The actuating button 130 is engaged with the extension 124 for simultaneous movement. On a curved outer surface 134 of the button 130 are a number of ridges 136 protruding outwardly of the outer surface 134. The ridges 136 run parallel to one another and are perpendicular to the longitudinal axis L—L of the body 102. The outer surface 134, which is orthogonal to the longitudinal end of the lighter 100, may be engaged by fingers of a user to slide the button 130 relative to the body 102 between a normal position, as shown in FIG. 1, to an operating position, as shown in FIG. 2. It can be seen that the direction of movement of the button 130 relative to the body 102 is parallel to the longitudinal axis L—L of the body 102. On a lateral side of the body 102 opposite to the actuating button 130 is provided with a thumb-engagement area 138, details of which will be discussed below.

In the normal position as shown in FIG. 1, the nozzle 114 is in the closed position in which no fuel exits from the nozzle 114. When the button 130 is slid downwardly relative to the body 102 to the operating position as shown in FIG. 2, the extension 124 pivots the lever 126, which in turn raises the nozzle 114 to the open position, so that fuel under pressure in the cavity 104 exits the nozzle 114 to the vicinity between the end 128*b* of the lead wire 128*a* and the nozzle 114.

At the same time, the upper portion 117 is moved downward by the lead wire 122 to come into contact with the hammer 120 of the piezo electric unit 118, against the biasing force of a reset spring 132. In this way, the nozzle 114, the lever 126, the extension 124, the lead line 122, the upper portion 117, the lower portion 120, the block 128, the lead wire 128*a* and the end 128*b* form an electric circuit which is only open in the small gap between the end 128*b* and the nozzle 114. When an electrically conductive head metal 133 of the upper portion 117 is hammered by the hammer 120, the piezo unit 118 will undergo an instantaneous minor compression/deformation, whereupon an electric arc will be produced in the gap between the end 128*b* and the nozzle 114, such that a spark is generated, which ignites the fuel leaving the nozzle 114, so that a flame is produced at the top longitudinal end of the lighter 100.

Upon release of the downward pushing force on the button 130, the reset spring 132 will return the button 130 to its normal position as shown in FIG. 1. The lever 126 will also be returned to its normal closed position as shown in FIG. 1, under the biasing force of the spring 116. No fuel can now exit the cavity 104 via the nozzle 114.

Figure 4:
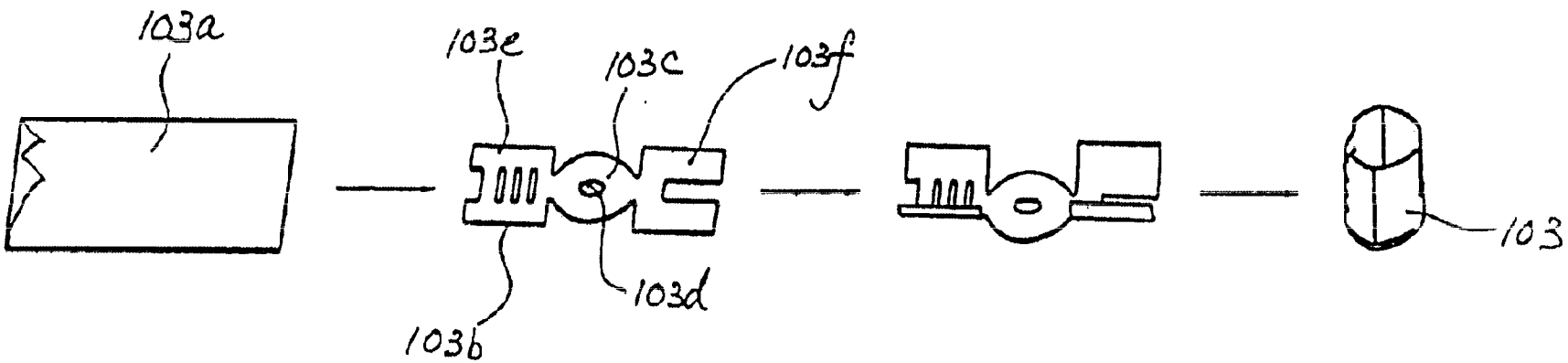
FIG. 4 shows the steps of formation of a windscreen cap of the lighter shown in FIG. 1.

As shown in FIG. 4, a small rectangular metal plate 103*a* from a long strip of metal plate is worked on to form the cap 103. Unwanted portions of the small metal plate 103*a* are punched away, e.g. by a punching machine, to form a punched metal plate 103*b*. The punched metal plate 103*b* has a generally oval central portion 103*c* with a circular aperture 103*d*. The central portion 103*c* is joined with two generally rectangular platelets 103*e*, 103*f*. Each of the platelets 103*e*, 103*f* is bent to form a curved plate, and they are then bent toward each other to form the windscreen cap 103.

Figure 5:
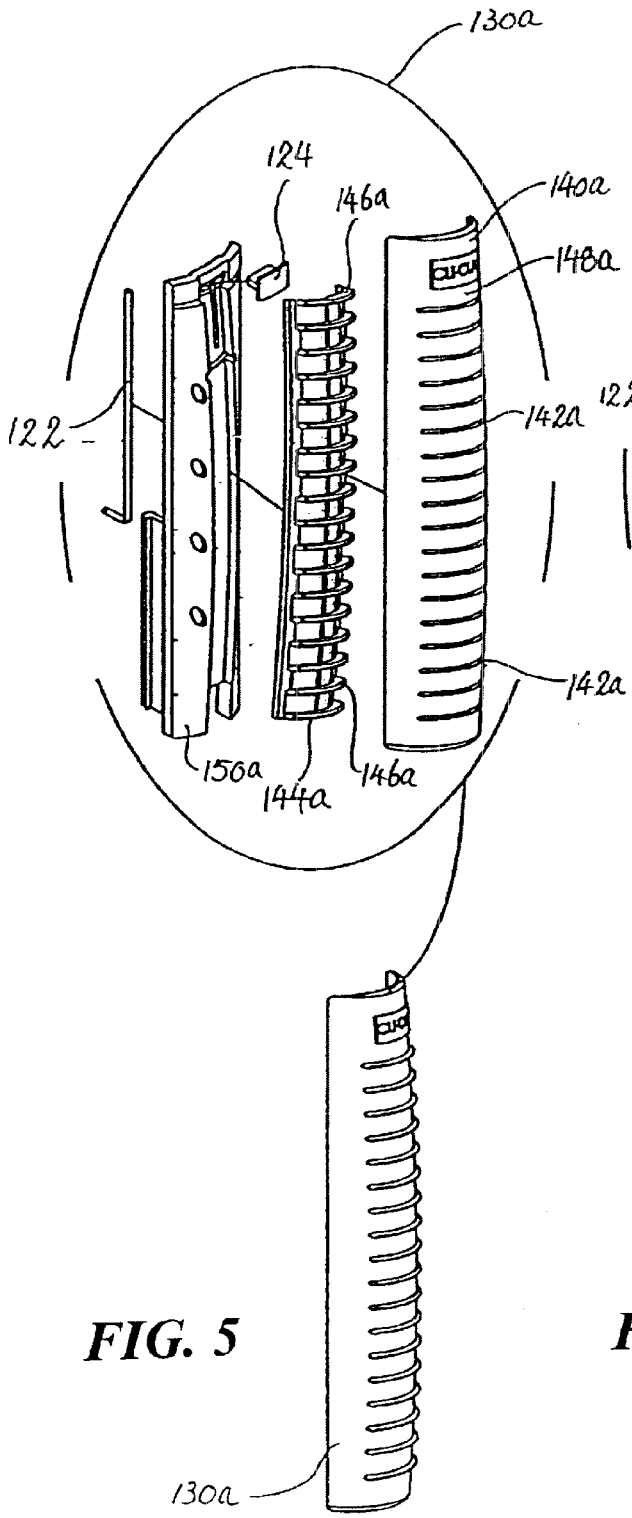
FIG. 5 shows the structure of a first arrangement of a actuating button of the lighter shown in FIG. 1.

FIG. 5 shows a first example of an actuating button 130*a*, with an exploded view of the components shown in a dotted oval. This actuating button 130*a* may be used in the lighter 100. The actuating button 130*a* includes a curved outer button 140*a* which is as long as the body 102. A number of slots 142*a* are provided on the outer button 140*a*. These slots 142*a* run parallel to one another and are perpendicular to the length of the button 130*a*. Engaged with the outer button 142*a* is a rib cage 144*a* with a number of ribs 146*a* running parallel to one another. When the outer button 140*a* is engaged with the rib cage 144*a*, each rib 146*a* is received within a respective slot 142*a* and protrudes beyond a curved outer surface 148*a* of the outer button 140*a*. Also engaged with the rib cage 144*a* and the outer button 140*a* is an inner button 150*a*, which is secured with the lead wire 122 and the extension 124, as discussed above.

Figure 6:
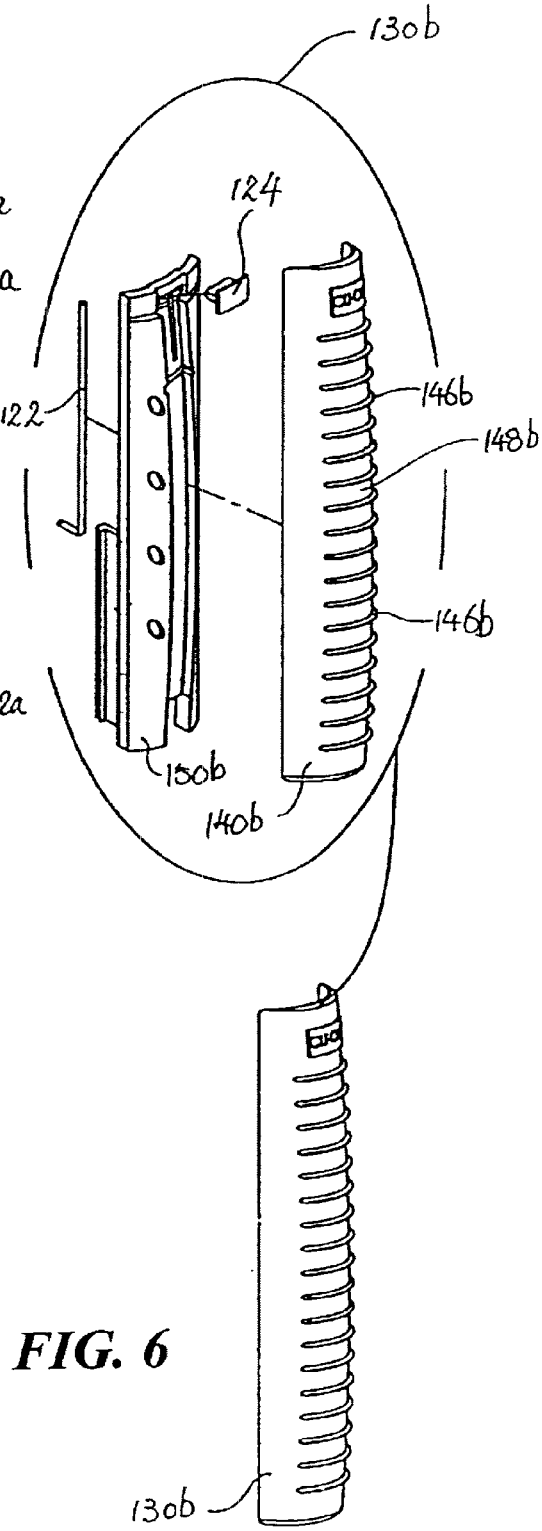
FIG. 6 shows the structure of a second arrangement of a actuating button of the lighter shown in FIG. 1.

FIG. 6 shows the structure of a second example of an actuating button 130*b*, with an exploded view of the components shown in a dotted oval. The button 130*b* includes an outer button 140*b* engaged with an inner button 150*b*, the extension 124 and the lead wire 122. Formed integrally with the outer button 140 are a number of ridges 146*b* running parallel to one another and perpendicular to the length of the outer button 140*b*. These ridges 146*b* protrude beyond a curved outer surface 148*b* of the outer button 140*b*. Both the ribs 146*a* of the button 130*a* and the ridges 146*b* of the button 130*b* can enhance the engagement between the fingers of a user and the button 130*a*, 130*b*.

Figure 7A:
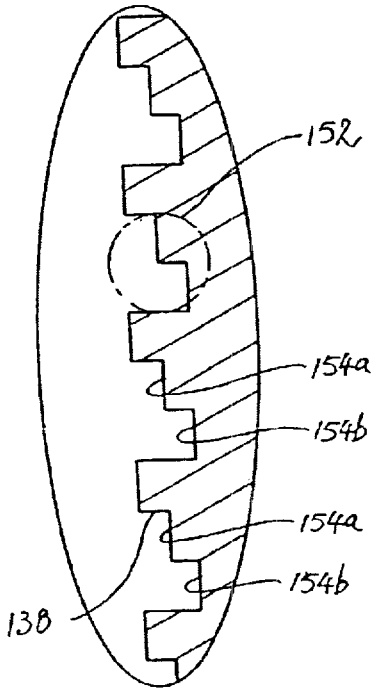
FIG. 7A is an enlarged partial side view of a thumb-engagement area of the lighter shown in FIG. 1.
Figure 7B:
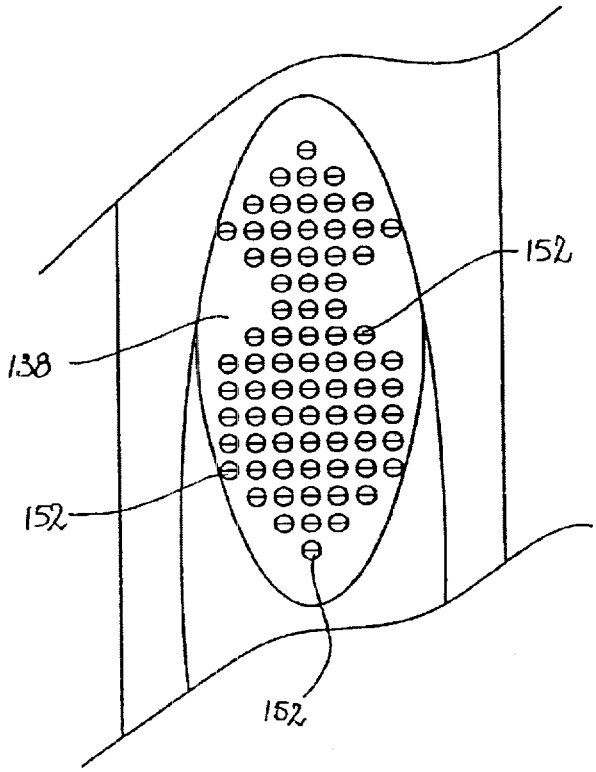
FIG. 7B is an enlarged partial front view of the thumb-engagement area of the lighter shown in FIG. 1.

As shown in FIGS. 7A and 7B, the thumb-engagement area 138 is generally oval in shape and includes a number of small circular recesses 152. Each circular recess 152 is formed of an upper stepped portion 154*a* and a lower stepped portion 154*b*. These circular recesses 152 serve to increase the friction, and thus enhance the engagement, between the thumb of the user and the body 102 of the lighter 100. The circular recesses 152 may also be arranged to form a pattern, as shown in FIG. 7B.

Figure 9B:
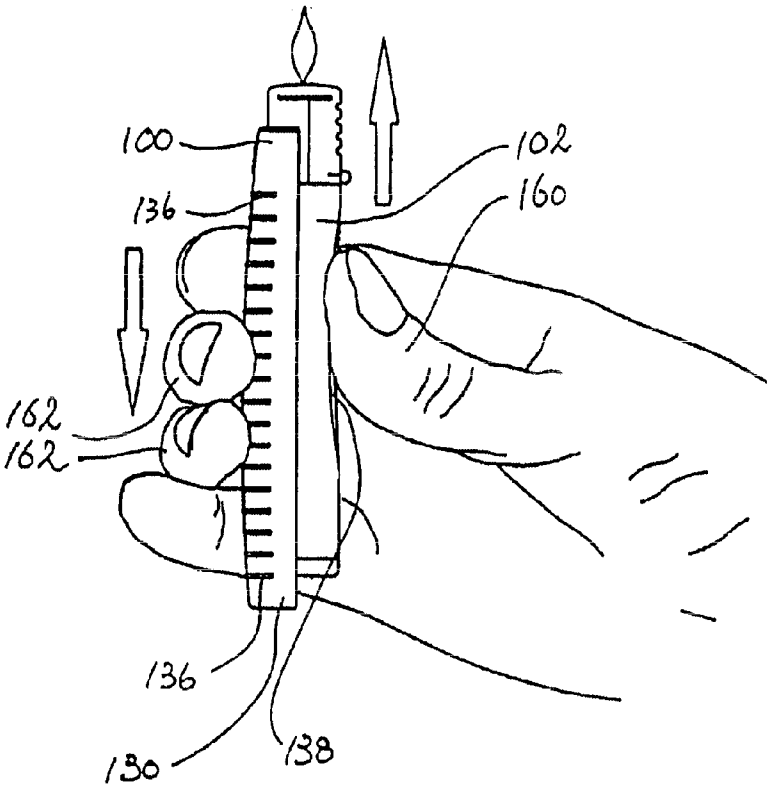
FIGS. 9A and 9B show the operation of the lighter shown in FIG. 1.
Figure 9A:
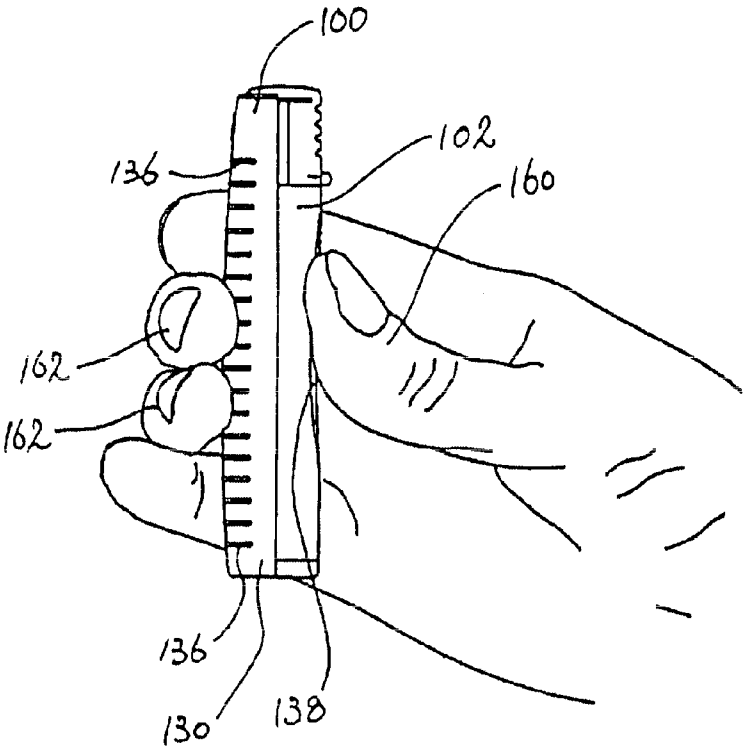

As can be seen in FIGS. 9A and 9B, a user may hold the lighter 100 by engaging his/her thumb 160 with the thumb-engagement area 138, while some of the remaining fingers 162 rest on the ridges 136 of the button 130. The button 130 may then be moved by the remaining fingers 162 downwardly relative to the body 102 of the lighter 100, or put another way, the body 102 may be moved by the thumb 160 upwardly relative to the button 130, to produce a flame, in the manner discussed above.

It is found in practice that the movement of the hand and fingers required to slide the button 130 relative to the body 102 to actuate the lighter 100 cannot be performed by most small children, e.g. ones under the age of three. The present arrangement thus effectively acts as a safety mechanism for preventing unwanted operation by most small children.

Figure 10:
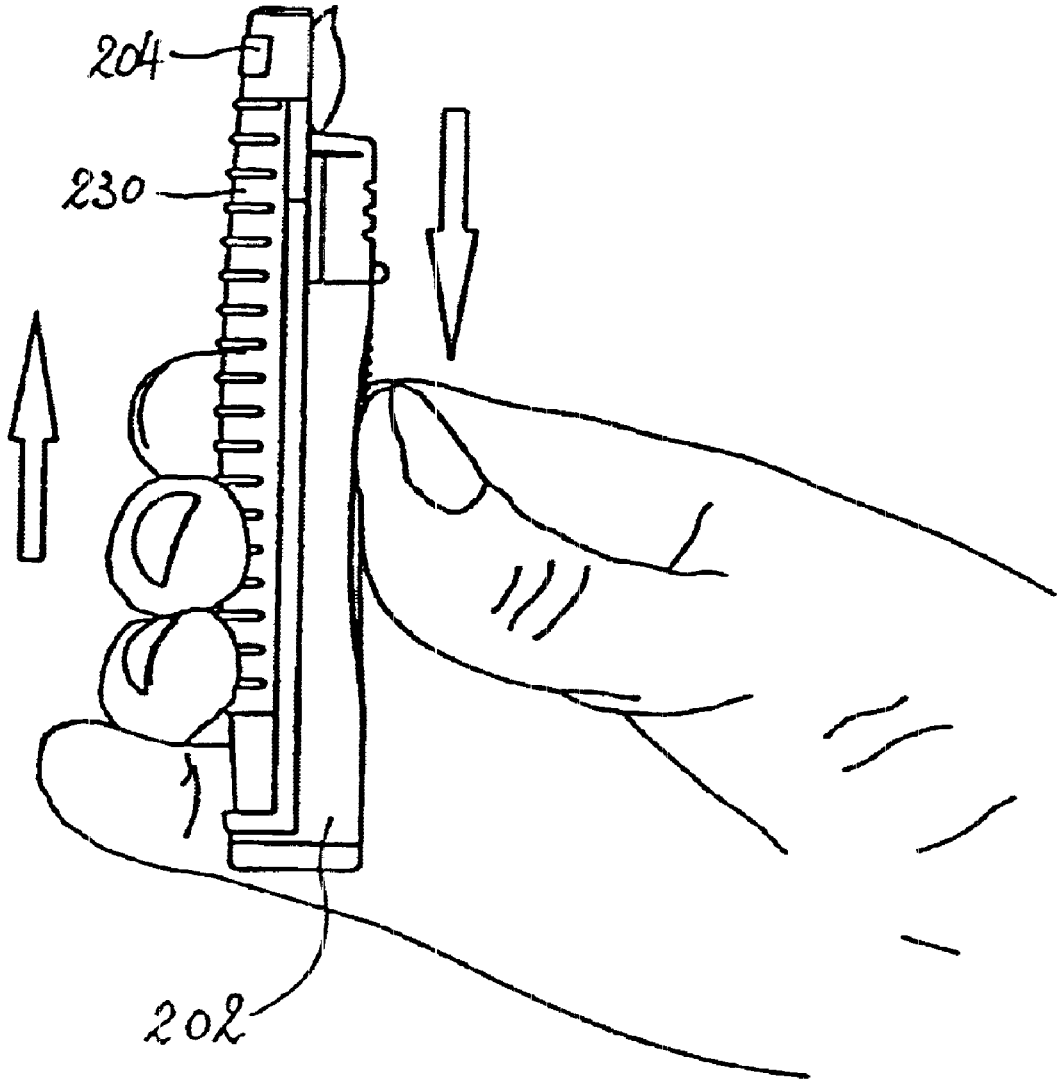
FIG. 10 shows the operation of a lighter according to a second embodiment of the present invention.
Figure 11:
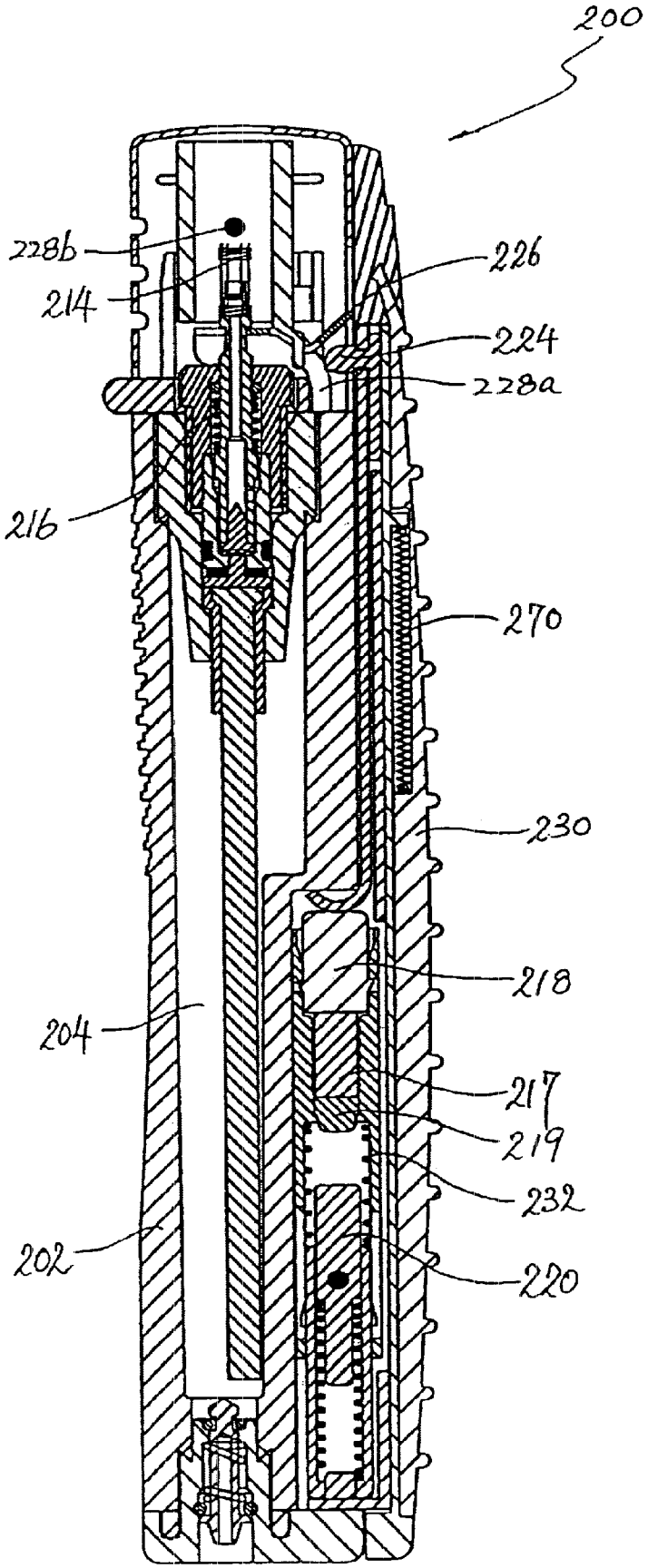
FIG. 11 is a longitudinal sectional view of the lighter shown in FIG. 10 in a normal state.
Figure 12:
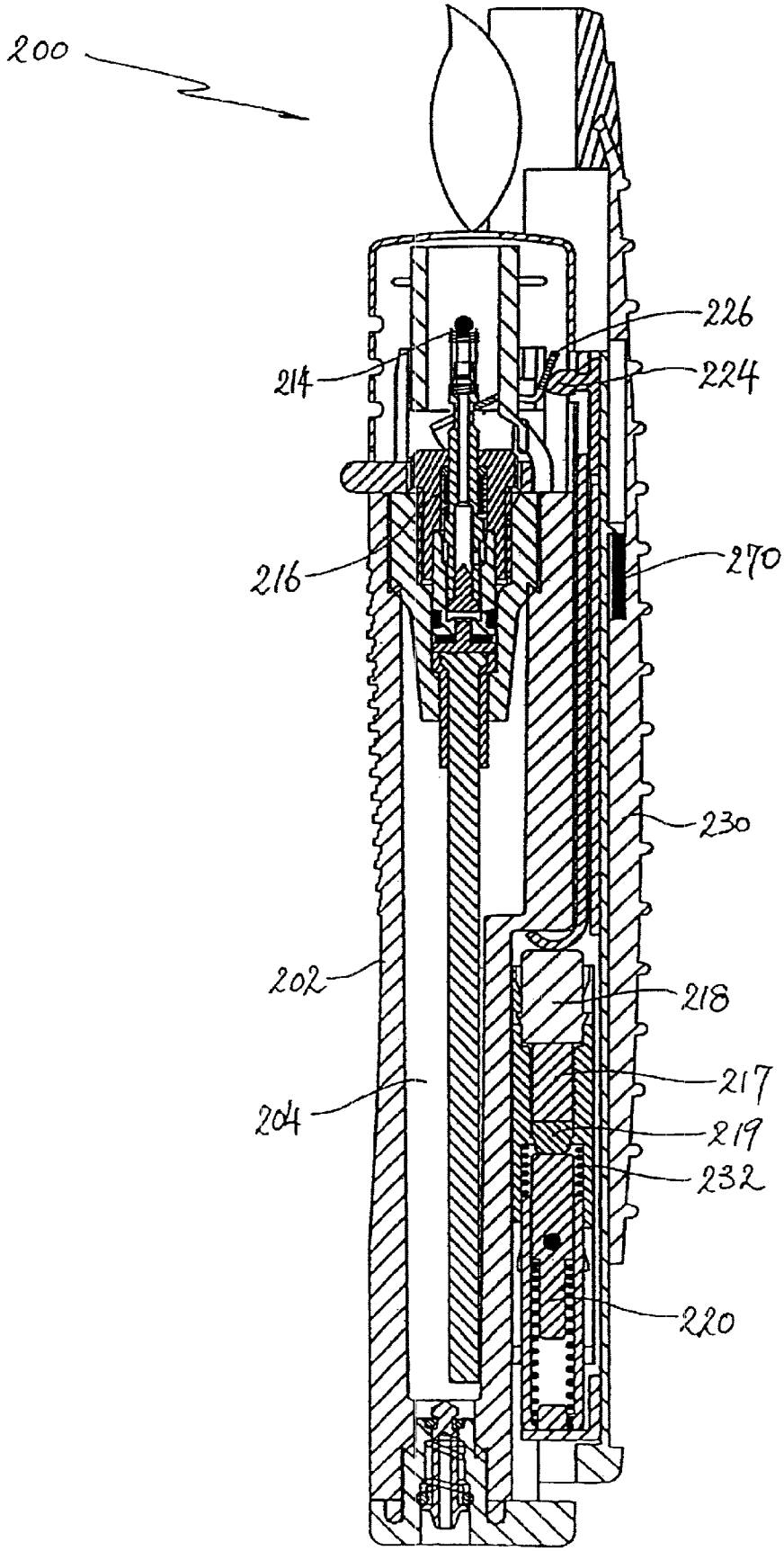
FIG. 12 is a longitudinal sectional view of the lighter shown in FIG. 10 in an operating state.

In the lighter 100 discussed above, a flame is produced when the button 130 is moved away from the top end of the lighter 100. An alternative embodiment is shown in FIGS. 10 to 12, to be discussed below. As can be seen in FIG. 10, in a lighter 200 according to this alternative embodiment, a body 202 may be moved downwardly relative to a button 230, or put another way, a button 230 may be moved upwardly relative to a body 202, to the position as shown in FIGS. 10 and 12, to produce a flame. An advantage of this arrangement is that an upper end 204 of the button 230 may act as a windscreen.

As can be seen in FIGS. 11 and 12, the general structure of the lighter 200 is similar to the lighter 100 discussed above. Only the main differences will thus be discussed below. The button 230 is mounted on a lateral side of the body 202 for relative sliding movement therebetween. Secured with the button 230 is a horizontal extension 224 which, in the normal position as shown in FIG. 11, is positioned below a lever 226. When the button 230 is moved upward relative to the body 202, the extension 224 will pivot the lever 226 to raise a nozzle 214, against the biasing force of a spring 216, to an open position (as shown in FIG. 12) in which fuel under pressure in a cavity 204 may exit via the nozzle 214.

When the button 230 is moved upwardly, against the biasing force of a spring 270, a hammer 220 of a piezo electric unit 217 is also brought upwardly, against the biasing force of a spring 232, to hammer a head metal 219 of the piezo electric unit 217, against the backing force of a back mass 218, to generate a spark between an end 228*b* of a lead wire 228*a* and the nozzle 214, in the same manner as in the lighter 100 discussed above. The spark will then ignite the fuel exiting the nozzle 214 to produce a flame.

Upon release of the upward pushing force on the button 230, the button 230 and the hammer 220 of the piezo electric unit 217 will return to the normal position shown in FIG. 10, upon the biasing force of the springs 270 and 232. The nozzle 214 will also return to the normal position shown in FIG. 10, upon the biasing force of the spring 216.

It should be understood that the above only illustrates examples whereby the present invention may be carried out, and that various modifications and/or alterations may be made thereto without departing from the spirit of the invention.

It should also be understood that certain features of the invention, which are, for clarity, described in the context of separate embodiments, may be provided in combination in a single embodiment. Conversely, various features of the invention which are, for brevity, described in the context of a single embodiment, may also be provided separately or in any appropriate sub-combinations.

What is claimed is:

1. A lighter including a body and an actuator, wherein said body included a spark generator, a container adapted to contain fuel under pressure, a longitudinal end at which a flame is adapted to be produced upon movement of said actuator relative to said body, and a nozzle arranged for passage of fuel through the nozzle upon said movement of said actuator, wherein said actuator is movable relative to said body substantially parallel to a longitudinal axis of said body, wherein said actuator includes an outer surface which is openable by a user to move said actuator relative to said body, wherein said outer surface of said actuator is generally orthogonal to said longitudinal end of said body, and wherein said actuator is generally as long as said body.

2. A lighter according to claim 1 wherein said outer surface of said actuator is curved.

3. A lighter according to claim 1 wherein said outer surface of said actuator includes a plurality of ridges.

4. A lighter according to claim 3 wherein said ridges are substantially perpendicular to said longitudinal axis of said body.

5. A lighter according to claim 3 wherein said ridges are formed integrally with said actuator.

6. A lighter according to claim 1 wherein a flame is adapted to be produced when said actuator is moved away from said longitudinal end of said body for a predetermined distance.

7. A lighter according to claim 1 wherein a flame is adapted to be produced when said actuator is moved towards said longitudinal end of said body for a predetermined distance.

8. A lighter according to claim 1 wherein a friction area is provided on an outer surface of said body for engagement with a finger of said user.

9. A lighter according to claim 8 wherein said finger is a thumb.

10. A lighter according to claim 1, wherein the nozzle is biased toward a closed position.

11. A lighter according to claim 1, wherein the flame is adapted to be produced at the nozzle upon said movement of said actuator.

12. A lighter according to claim 1, wherein said movement of said actuator moves said nozzle in a direction relative to said body.

13. A lighter including a body and an actuator, wherein said body includes a spark generator and container adapted to contain fuel under pressure, said body further including a longitudinal end at which a flame is adapted to be produced upon movement of said actuator relative to said body, wherein said actuator is movable relative to said body substantially parallel to a longitudinal axis of said body, wherein said actuator includes an outer surface which is operable by a user to move said actuator relative to said body, wherein said outer surface of said actuator is generally orthogonal to said longitudinal end of said body, and wherein said actuator is generally as long as said body, wherein said outer surface of said actuator includes a plurality of ridges, wherein said actuator includes a first member and a second member engaged with each other, and wherein said first member includes a plurality of apertures and said second member includes a plurality of ridges each receivable within a respective aperture of said first member.

14. A lighter according to claim 13 wherein said apertures are substantially parallel to each other.

15. A lighter according to claim 13 wherein said ridges are substantially parallel to each other.

16. A lighter including a body and an actuator, wherein said body includes a spark generator and a container adapted to contain fuel under pressure, said body further including a longitudinal end at which a flame is adapted to be produced upon movement of said actuator relative to said body, wherein said actuator is movable relative to said body substantially parallel to a longitudinal axis of said body, wherein said actuator includes an outer surface which is operable by a user to move said actuator relative to said body, wherein said outer surface of said actuator is generally orthogonal to said longitudinal end of said body, and wherein said actuator is generally as long as said body, wherein a flame is adapted to be produced when said actuator is moved towards said longitudinal end of said body for a predetermined distance, wherein at least part of said actuator acts as a windscreen when said actuator is moved towards said longitudinal end of said body for said predetermined distance.

17. A lighter including a body and an actuator, wherein said body includes a spark generator, a container adapted to contain fuel under pressure, a longitudinal end at which a flame is adapted to be produced upon movement of said actuator relative to said body, arid a nozzle adapted for passage of fuel through the nozzle upon said movement of said actuator, wherein said actuator is movable relative to said body substantially parallel to a longitudinal axis of said body, wherein said actuator is provided outside a lateral side of said body, and wherein said actuator is generally as long as said body.

18. A lighter according to claim 17 wherein said actuator has a curved outer surface.

19. A lighter according to claim 17 wherein said outer surface of said actuator includes a plurality of ridges.

20. A lighter according to claim 19 wherein said ridges are substantially perpendicular to said longitudinal axis of said body.

21. A lighter according to claim 19 wherein said ridges are formed integrally with said actuator.

22. A lighter according to claim 17 wherein a flame is adapted to be produced when said actuator is moved away from said longitudinal end of said body for a predetermined distance.

23. A lighter according to claim 17 wherein a flame is adapted to be produced when said actuator is moved towards said longitudinal end of said body for a predetermined distance.

24. A lighter according to claim 17 wherein a friction area is provided on an outer surface of said body for engagement with a finger of said user.

25. A lighter according to claim 24 wherein said finger is a thumb.

26. A lighter according to claim 17, wherein the nozzle is biased toward a closed position.

27. A lighter according to claim 17, wherein the flame is adapted to be produced at the nozzle upon said movement of said actuator.

28. A lighter according to claim 17, wherein said movement of said actuator moves said nozzle in direction relative to said body.

29. A lighter including a body and an actuator, wherein said body includes a spark generator and a container adapted to contain fuel under pressure, said body further including a longitudinal end at which a flame is adapted to be produced upon movement of said actuator relative to said body, wherein said actuator is movable relative to said body substantially parallel to a longitudinal axis of said body, wherein said actuator includes an outer surface which is operable by a user to move said actuator relative to said body, wherein said outer surface of said actuator is generally orthogonal to said longitudinal end of said body, anti wherein said actuator is generally as long as said body, wherein said outer surface of said actuator includes a plurality of ridges, wherein said actuator includes a first member and a second member engaged with each other, and wherein said first member includes a plurality of apertures and said second member includes a plurality of ridges each receivable within a respective aperture of said first member.

30. A lighter according to claim 29 wherein said apertures are substantially parallel to each other.

31. A lighter according to claim 29 wherein said ridges are substantially parallel to each other.

32. A lighter including a body and an actuator, wherein said body includes a spark generator and container adapted to contain fuel under pressure, said body further including a longitudinal end at which a flame is adapted to be produced upon movement of said actuator relative to said body, wherein said actuator is movable relative to said body substantially parallel to a longitudinal axis of said body, wherein said actuator includes an outer surface which is operable by a user to move said actuator relative to said body, wherein said outer surface of said actuator is generally orthogonal to said longitudinal end of said body, and wherein said actuator is generally as long as said body, wherein a flame is adapted to be produced when said actuator is moved towards said longitudinal end of said body for a predetermined distance, wherein at least part of said actuator acts as a windscreen when said actuator is moved towards said longitudinal end of said body for said predetermined distance.

33. A lighter including a body and an actuator, wherein said body includes a spark generator, a container adapted to contain fuel under pressure, a longitudinal and at which a flame is adapted to be produced upon movement of said actuator relative to said body, and an aperture arranged at said longitudinal end for passage of fuel through the aperture upon said movement of said actuator, wherein said actuator is movable relative to said body substantially parallel to a longitudinal axis of said body, he actuator adapted so said movement opens said aperture, wherein said actuator includes an outer surface which is operable by a user to move said actuator relative to said body, wherein said outer surface of said actuator is generally orthogonal to said longitudinal end of said body, and wherein said actuator is generally as long as said body.

34. A lighter according to claim 33, wherein said aperture is biased toward a closed position to prevent the flow of fuel through the aperture.

* * * * *